US005593156A

United States Patent [19]

Jambor

[11] Patent Number: 5,593,156

[45] Date of Patent: Jan. 14, 1997

[54] GROUND MARKER AND METHODS OF USING SAME TO MARK DISTANCES AND/OR ADVERTISE ON A GOLF COURSE

[75] Inventor: Charles E. Jambor, Simcoe, Canada

[73] Assignee: Karoly-J Ltd., Simcoe, Canada

[21] Appl. No.: 388,544

[22] Filed: Feb. 14, 1995

Related U.S. Application Data

[63] Continuation-in-part of Ser. No. 165,615, Dec. 13, 1993, abandoned.

[51] Int. Cl.[6] ..... A63B 57/00

[52] U.S. Cl. ..... 40/584; 40/217; 404/13; 473/150

[58] Field of Search ..... 404/12, 13, 14; 40/612, 217; 52/103, 104; 273/34, 176

[56] References Cited

U.S. PATENT DOCUMENTS

| | | |
|---|---|---|
| D. 273,095 | 3/1984 | Schulze . |
| 885,850 | 4/1908 | Josenhans . |
| 2,159,458 | 5/1939 | Stoddard . |
| 2,800,099 | 7/1957 | Baker . |
| 3,521,596 | 7/1970 | Schlein . |
| 3,634,961 | 1/1972 | Nawalaniec . |
| 3,699,913 | 10/1972 | Sautbine . |
| 3,916,821 | 11/1975 | Pies . |
| 3,920,348 | 11/1975 | Paulos . |
| 4,054,000 | 10/1977 | Lisle . |
| 4,284,365 | 8/1981 | Rabinow . |
| 4,302,125 | 11/1981 | Cullen, Jr. . |
| 4,428,168 | 1/1984 | Tomer . |
| 4,489,669 | 12/1984 | Carman . |
| 4,739,302 | 4/1988 | Kinard . |
| 4,779,375 | 10/1988 | White . |
| 4,783,071 | 11/1988 | Tattershall . |
| 5,044,634 | 3/1991 | Dudley . |
| 5,072,940 | 12/1991 | Bailey . |
| 5,219,171 | 6/1993 | Kirby . |
| 5,249,384 | 10/1993 | Dark, Jr. . |

FOREIGN PATENT DOCUMENTS

| | | |
|---|---|---|
| 2202155 | 9/1988 | United Kingdom . |

*Primary Examiner*—Mark S. Graham
*Attorney, Agent, or Firm*—Bereskin & Parr

[57] ABSTRACT

A ground marker is provided for displaying distance and advertising information on a golf course. The marker has a body that is dimensioned to fit entirely within a predetermined size hole defined in the ground. The body has a top portion and a base that are generally cylindrical and coaxial. The top portion has a transparent top face that is positioned generally flush with the ground surface, and a protruding lip that is dimensioned to bear against the side of the hole. The top face is formed from a clear plastic filler positioned over a card containing markings. The filler has a hardness comparable to the hardness of a grassy fairway. The lip of the marker has a bottom surface that abuts with a tool for permitting easy removal of the marker from the hole. A method of marking distances on a golf course is provided by arranging a plurality of markers at spaced intervals along concentric radii measured from the golf green. A method of advertising on a golf course is provided by displaying advertising markings on the card so that the advertisement is visible when the marker is submerged in the ground.

20 Claims, 6 Drawing Sheets

GROUND MARKER AND METHODS OF USING SAME TO MARK DISTANCES AND/OR ADVERTISE ON A GOLF COURSE

This is a continuation-in-part of application Ser. No. 08/165,615 filed Dec. 13, 1993, abandoned.

FIELD OF THE INVENTION

This invention relates to ground markers, such as distance markers used at a golf course, and to methods of marking distances and advertising at a golf course.

BACKGROUND OF THE INVENTION

It is known to locate a marker in the ground to delineate a path, to indicate distance to an object, or to convey information (such as a historical plaque). At golf courses for instance, markers are typically used to indicate the distance from the marker to the centre of the green.

One type of marker often used at golf courses is a coloured stake, or another identifiable indicator, protruding from the ground a predetermined distance (usually 150 yards) from the centre of the green. The golfer estimates by eye, or paces off, the distance between his ball and the marker to determine how far his ball is from the centre of the green. The golfer is then better able to decide on the appropriate club to use to hit the ball on to the green.

A problem with this type of marker is that it protrudes from the ground and thus acts as an unnatural obstruction on the golf course. As a result, only one or two markers are used on each hole, and usually these are located at the sides of the fairway. Because only one or two markers are provided, it is often difficult for the golfer to quickly and accurately estimate the distance of his shot. It is especially difficult if the golfer's ball is on the opposite side of the fairway from the marker, and thus at a different angle toward the green. Speed of play is effected by the golfer's indecision. The time required for the golfer to estimate the distance by eye, or to pace off the distance to the marker tends to frustrate other golfers, and can have an economic effect upon the golf course (by reducing the rate of golf rounds per hour).

Another type of marker used at golf courses, often in conjunction with the first type of marker, is a numerical marking that is affixed to the top of sprinkler heads that may be submerged throughout the fairway. Unfortunately, the sprinkler heads are not located at consistent positions about the fairway and are generally too far apart to be easily located by the golfer. Also, the small size of the sprinkler heads only accepts small size yardage markings, which tend to be difficult to read. For these reasons, time is again wasted as golfers wander about trying to locate the sprinkler heads to estimate distances. Also, in many climates, courses do not require a sprinkler system.

Another type of marker used at golf courses is a cement slab located generally flush with the ground along the centre line of the fairway. Such slabs may be colour-coded and located at predetermined distances along the fairway. For instance, a red slab may be located at 100 yards, a white slab at 150 yards, and a blue slab at 200 yards. A problem with the concrete slabs is that they tend to cause unnatural bounces of a golf ball and thus act as an unnatural obstruction on the course. In addition, the slabs can cause damage to other pieces of golf course equipment, such as aerating machines. For these reasons only a few slabs would be used for each hole, which leads to the same speed and accuracy problems as were associated with the first type of marker.

Yet another type of marker is described in U.K. patent application 2,202,155 (Solheim) published in 1988. This application describes a marker that is substantially submerged in the ground at predetermined distances on opposite sides of an imaginary centre line of the fairway. The markers are anchored to the ground with cement with the top of the markers extending slightly above ground level.

There are a number of problems with the Solheim marker. For instance, the Solheim marker is not easily removable from the fairway. This is a problem since it does not permit the fairways to be periodically aerated without damaging the aerating machines or the markers. Furthermore, grass tends to grow over markers that are close the ground. When the markers have a relatively small surface area, such as the Solheim markers, it is necessary to trim the grass to avoid the marker from being obliterated. It would be a time consuming task to trim the grass around the numerous permanently anchored markers described in the Solheim application. Also, the upper surface of the Solheim marker is convex in profile and protrudes slightly above ground level to expose a side edge. A golf ball striking the convex surface or the side edge would be deflected unnaturally compared to a golf ball striking the grassy ground. This is, of course, undesirable since the marker should be as unobtrusive as possible. The risk of a golf ball striking the marker surface is multiplied as more markers are located about the fairway. Furthermore, the marking system described in Solheim utilizes only a pair of markers at each distance. This provides little assistance on wider fairways, where the golf ball may be located some distance away from the markers.

There is a need for a ground marker that is easily removable from the ground and that does not require frequent trimming of the grass that tends to grow over its surface. The ground marker should be unobtrusive when used as a distance marker at golf courses so that it will not effect the flight of a golf ball. Finally, the ground marker should be inexpensive to manufacture and easy to install or remove.

An additional problem faced by golf courses is the cost involved in operating the course. The cost of obtaining and servicing equipment, such as markers, can be prohibitive. To recover a portion of these costs, some golf courses have rented advertising space at locations around the golf course. Commercial advertisements have appeared on signboards located at the tees, and in the golf cups located in the green (see U.S. Pat. No. 5,249,384 to Dark, Jr.). While these methods of advertising provide an additional source of revenue, it is desirable that further methods of obtaining advertising revenue be developed. Preferably, these methods would be relatively unobtrusive so as not to deter from the appearance of the golf course and the play of the game.

SUMMARY OF THE INVENTION

In accordance with one aspect of the present invention, there is provided a ground marker comprising:

a body having a top portion and a base;

said top portion having a generally cylindrical side wall and a horizontal substantially planar transparent top face, said side wall having a greater outer diameter than the outer dimension of said base to define a peripheral lip having a bottom edge; and display means being disposed beneath said transparent top face, said display means being visible through said transparent top face; wherein said body is adapted to fit in a predetermined size hole defined in the ground with said top face being generally flush with the ground surface and said side wall contacting the side of said hole.

Advantageously, the shape-of the ground marker permits it to be easily installed and removed from the ground. The bottom edge of the lip is adapted to engage a removal tool. The lip also acts to draw grass growing over the hole into the hole when the marker is inserted. The planar top face of the marker sits substantially flush with the surface of the ground so as not to unduly effect the travel of the golf ball. In a preferred embodiment of the marker, the top face is formed from a material that compares to the hardness of a fairway. A golf ball striking this material would bounce to approximately the same extent as if it had struck the fairway itself.

In accordance with a second aspect of the present invention, there is provided a method for marking the distances on a golf course comprising the steps of:

measuring a plurality of concentric radii on the golf course relative to a corresponding golf green;

digging a plurality of predetermined size holes in the ground at spaced intervals along said radii;

inserting a marker into each of said holes, said marker having a top portion and a base, said top portion having a generally cylindrical side wall and a horizontal substantially planar transparent top face, said side wall having a greater outer diameter than the outer dimension of said base to define a peripheral lip having a bottom edge adapted to engage a tool for raising said marker from the ground, and display means being disposed beneath said transparent top face, said display means incorporating distance markings that are visible through said transparent top face, wherein said marker is positioned in said hole with said top face being generally flush with the ground surface; and raising one or more of said markers from said holes with said tool on a periodic basis without substantially damaging said holes to treat said marker or said golf course, and subsequently reinserting said markers in said holes.

Advantageously, the method provides many distance markers on a series of radii from the golf green so that it is easy for a golfer to locate a marker. Each marker has a planar top face that sits generally flush with the ground so that the numerous markers will not be obtrusive and effect the travel of a golf ball. The surface area of the top is relatively small, and the top face, in a preferred embodiment, is formed from a material that compares to the hardness of the fairway. Accordingly, numerous golf markers may be located on a radius without unduly effecting the travel of the golf ball.

In accordance with a third aspect of the present invention, there is provided a method of advertising on a golf course, comprising the steps of:

providing a marker having a top portion and a base, said top portion having a generally cylindrical side wall and a horizontal substantially planar transparent top face, said side wall having a greater outer diameter than the outer dimension of said base to define a peripheral lip having a bottom edge, and display means being disposed beneath said transparent top face, said display means incorporating commercial advertising material that is visible through said transparent top face, and submerging said marker into a hole in the ground at a predetermined location on a golf course so that said top face is generally flush with the ground surface and said side wall contacts the side of the hole; wherein said advertising material remains visible at said top face.

Advantageously, the advertisement on the golf markers will be frequently observed by golfers. In a preferred embodiment the marker also includes distance markings. A golfer must seek out the markers each time he wishes to determine the distance his ball is located from the green. At such time, the golfer will be presented with the advertisement located on the marker. The structure of the marker permits a plurality of markers, and thus advertisements, to be located on a fairway. The structure of each marker also permits the markers to be easily installed and removed from the fairway. The top face of the marker may thus be kept clear of dirt and grass that tends to grow over the surface and cover the advertisement. Also, the markers may be easily replaced with a fresh marker containing a new advertisement. The method of advertising allows golf courses to provide an advanced distance marking system and collect advertising revenues at the same time.

BRIEF DESCRIPTION OF THE DRAWINGS

For a better understanding of the present invention, and to show more clearly how it may be carried into effect, reference will now be made, by way of example, to the accompanying drawings. The drawings show a preferred embodiment of the present invention, in which.

DETAILED DESCRIPTION OF THE PREFERRED EMBODIMENT

Figure 1:
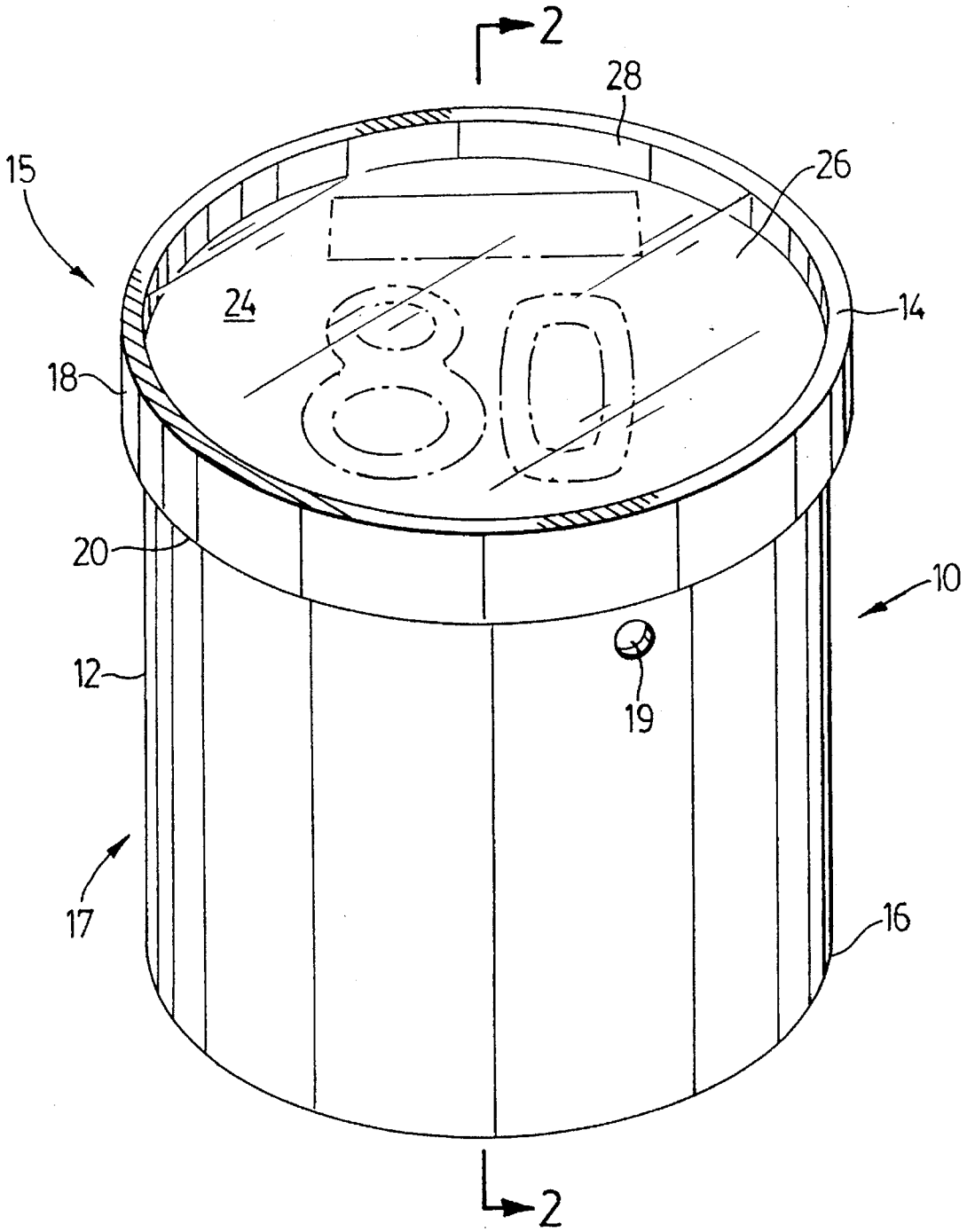
FIG. 1 is a perspective view of a ground marker in accordance with the present invention.

A ground marker in accordance with the present invention is shown generally at 10 in FIG. 1. The ground marker 10 comprises a body 12 having a top portion 15 and a base 17 that are each generally cylindrical and arranged along a common axis. The top portion 17 being greater in diameter than the base 17 and the side wall of the top portion defining a peripheral lip 18. The lip 18 has a flat bottom edge 20 for engaging a removal tool as described further below. The base 17 is hollow and has an open bottom end 16. A vent opening 19 is defined in the wall of the base 17 below the lip 18. The vent opening 19 provides for pressure equilibrium between the interior and exterior of the base 17 as described below.

Figure 2:
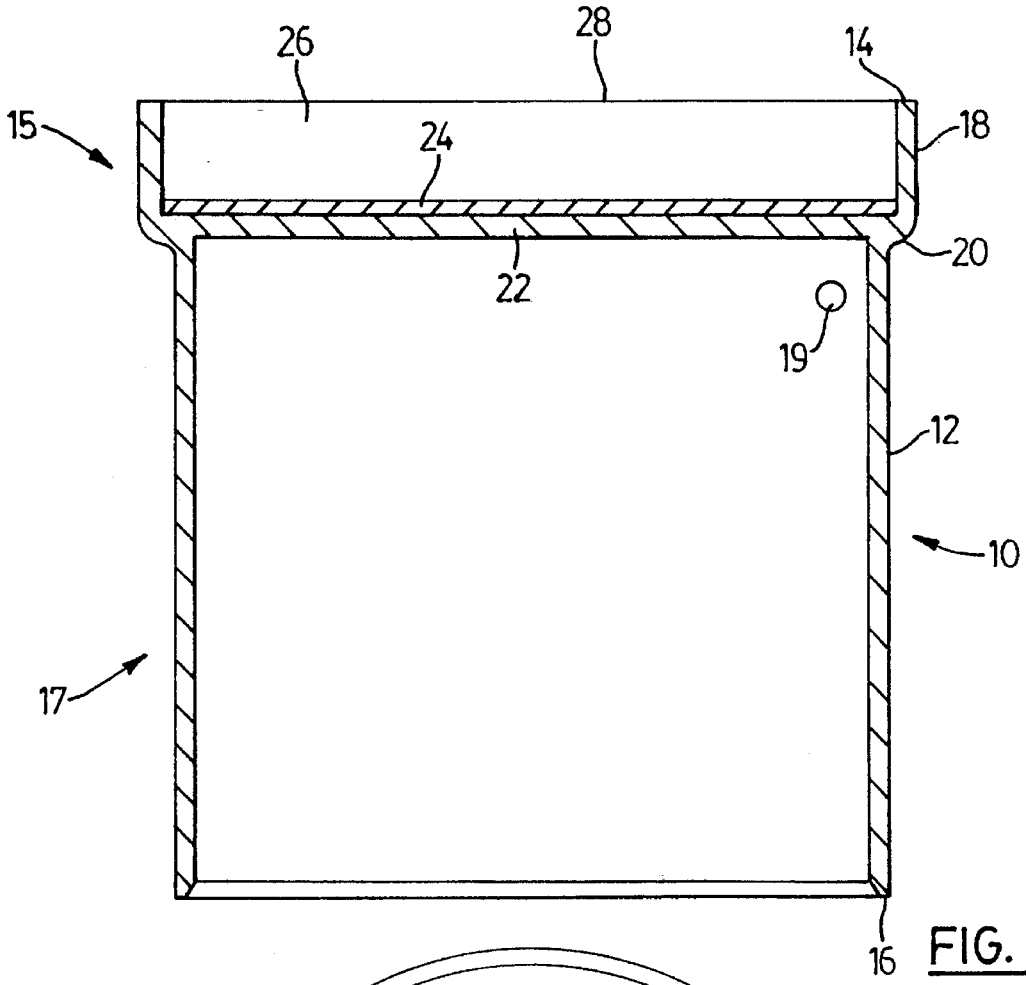
FIG. 2 is a sectional view of the ground marker of FIG. 1, as taken along lines 2—2.

Referring to FIG. 2, it can be seen that the body 12 includes a partition 22 positioned generally between the top portion 15 and the base. The partition 22 supports a display means such as a card 24 that contains distance markings, advertising matter, or other information. Preferably, the body 12, including the lip 18 and the partition 22, is formed by injection moulding as a one-piece unit. This allows the marker to be easily and inexpensively manufactured.

A transparent filler 26 is deposited over the card 24 to define a transparent top face 28 of the marker. As shown, the top face 28 is substantially planar with the filler 26 being generally flush with the top end 14 of the body 12. The filler 26 is formed from a substantially inelastic plastic material. It has been found that a high gloss polymer material is suitable for this purpose. The material is selected to have a hardness that is comparable to the hardness of a regular grassy fairway. A hardness range of between 90 Shore A and Shore 70D depending on temperature is preferred. Thus, the material should not greatly effect the bounce of a golf ball that strikes the top face 28 of the marker. It has been found that golf balls that strike cement markers or steel sprinkler heads tend to bounce unnaturally high compared to golf balls that strike the grassy fairway. The plastic filler 26 also acts as a protective cover for the card 24. The filler 26 resists scratches or scuffing from a golfer's spikes or from grass cutting equipment and resists damage caused by exposure to the weather.

Figure 3:
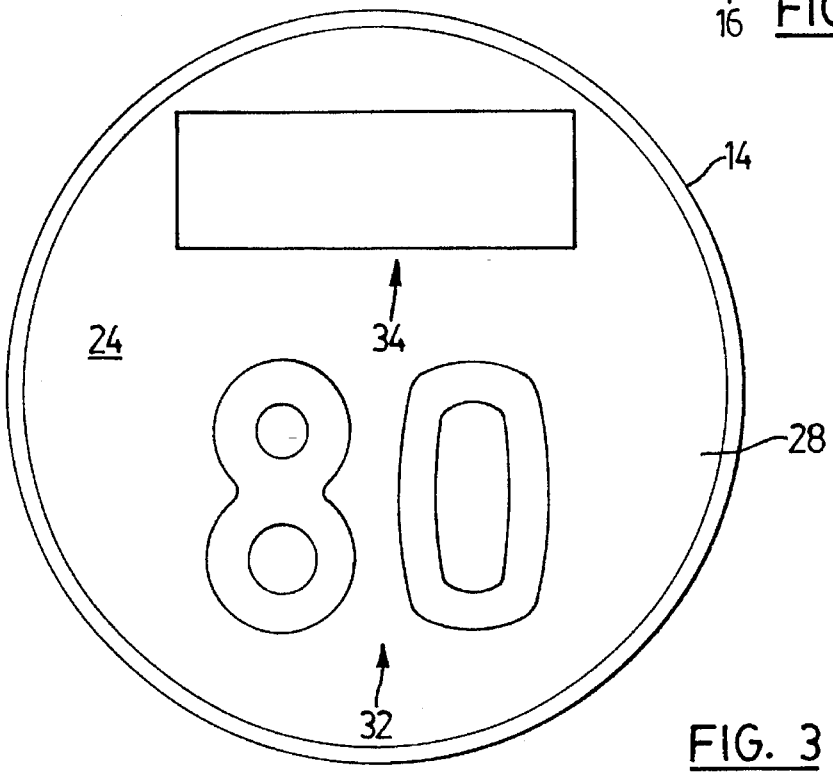
FIG. 3 is a top view of the ground marker of FIG. 1.

FIG. 3 shows one way in which markings may be arranged for display on the card 24 beneath the transparent filler 26. FIG. 3 depicts a distance marking 32 and an advertising marking 34. Of course, the invention is in no way limited by the sort of marking that may appear. The marking may be as simple as a coloured top face 28 (or a coloured card suspended below the transparent filler 26). It is preferred that actual distance markings 32 be provided however to avoid any confusion to a golfer.

Figures 4A, 4B, 4C:
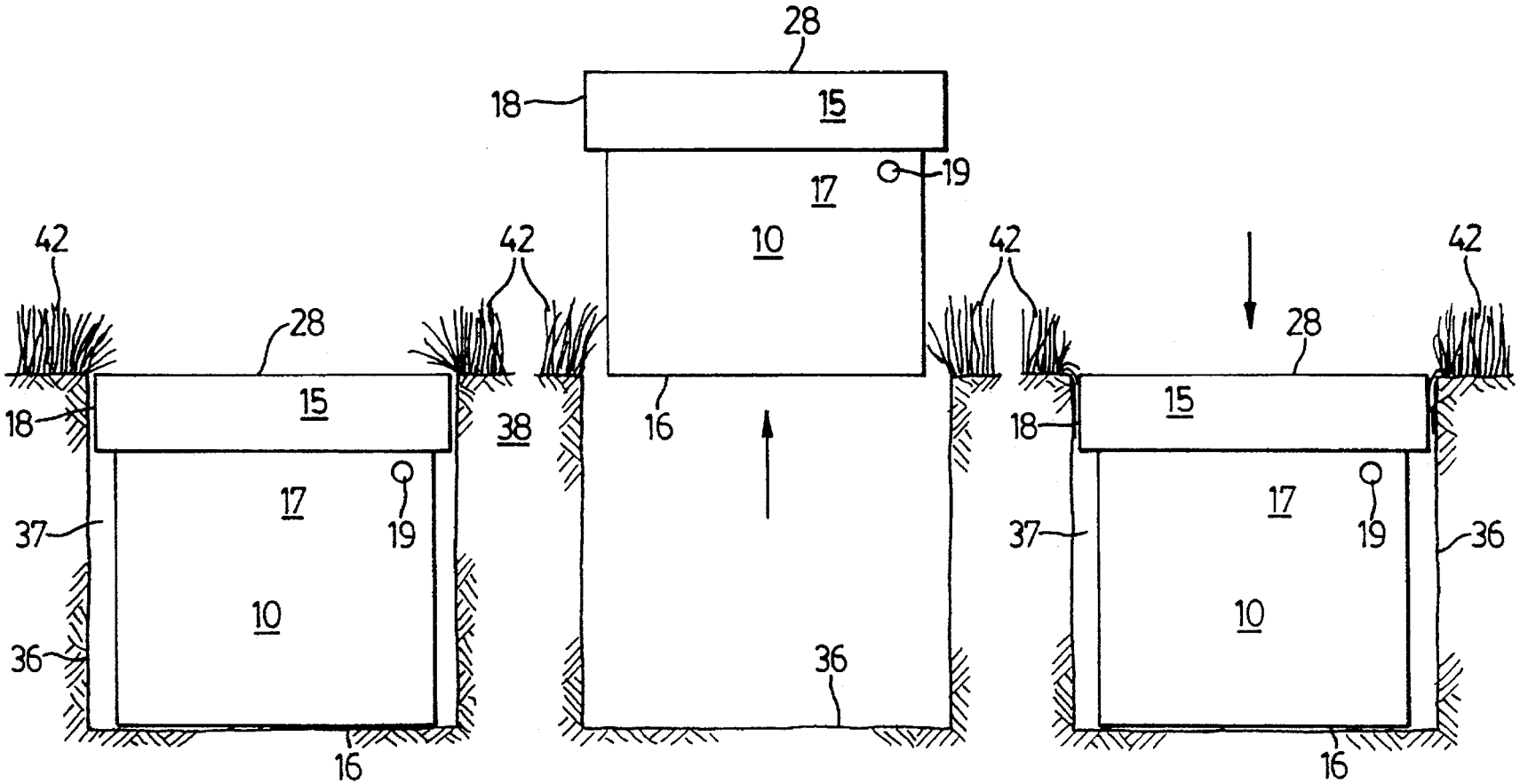
FIGS. 4(*a*)–4(*c*) are sequential views of a ground marker being removed and reinserted into the ground in accordance with the present invention.

As shown in FIGS. 4(*a*) to (*c*), the marker is adapted to fit within a predetermined size hole 36 defined in the ground 38 (such as in a fairway of a golf course). Conveniently, such a hole 36 may be dug with a conventional digging tool 40 (shown in FIG. 5) normally used for digging holes 36 in a golf green. The tool 40 creates a circular hole 36 having a depth of approximately four inches and a diameter of approximately four and one quarter inches.

The marker is sized to fit within the hole 36 with the bottom end 16 of the marker resting on the bottom of the hole 36 and the top face 28 of the marker located generally flush with the top of the hole 36. The lip 18 of the marker bears contacts the side of the hole 36. The base 17 is smaller in diameter than the top portion and defines a gap 37 between the wall of the base 17 and the side of the hole 36. The gap 37 provides space for roots and the like to grow into the hole 36 without disturbing the fit of the marker. Also, the gap 37 provides space for the hole 36 to shrink when the ground freezes in the wintertime. This allows the markers to be kept in the ground during the winter season.

The bottom end 16 of the marker is bevelled to penetrate any loose dirt that may accumulate at the bottom of the hole 36, such as anthills. This assists the marker in sitting with its top face 28 flush with, or slightly below the top of the hole 36. Also, the vent opening 19 defined in the wall of the base 17 acts as an air outlet in cases where the hollow base 17 becomes filled with water, dirt or the like. This prevents the marker from being raised above the hole for example in cases where it has rained, or when the ground has been watered.

Figure 5:
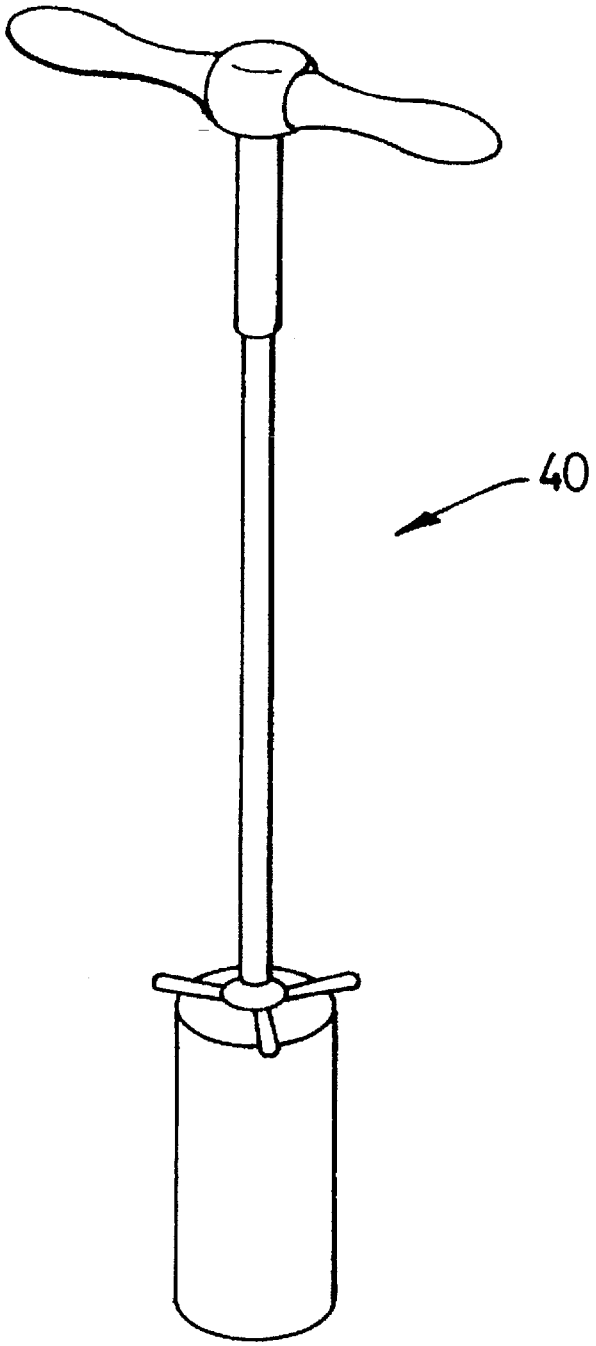
FIG. 5 is a perspective view of a conventional hole digging tool used in accordance with the present invention.

It will be appreciated that alternate sizes and shapes of holes 36 and corresponding ground markers may be utilized. The embodiment described above is preferred however for a number of reasons. First, it allows a conventional hole digging tool 40 (as shown in FIG. 5) to be used to accurately dig circular holes 36 of a predetermined size. Second, a circular hole 36 is easier to dig accurately then a rectilinear hole 36. Third, a circular hole 36 permits the marker to be rotated so that its markings, distance markings 32 for instance, are aimed in the direction of the golf green. A square hole, for instance, would limit the choices for angular orientation of the marker. Fourth, a four inch diameter marker is large enough to be easily spotted by a golfer, and small enough to avoid being an eyesore or an obstruction.

As shown in FIG. 4(*a*), once the marker is seated in the hole 36 for a period of time (usually a few weeks) the surrounding grass 42 tends to grow sideways over the marker. Unless this grass 42 is trimmed periodically, it will eventually cover the top face 28 of the marker. It has also been found that insects, such as ants, frequently deposit sand and other materials on the top face 28 of the marker.

To overcome these problems, the marker is constructed so that it may be easily removed, cleaned, and reinserted into the hole 36 as shown in FIGS. 4(*b*) and 4(*c*). When the marker is removed from the hole 36 as shown in FIG. 4(*b*), it can be wiped with a cloth, or simply turned over and wiped on the grass 42 (the dewy grass 42 of early morning is especially suitable for this) to remove the sand, fertilizer, and other materials deposited on its face. When the marker is reinserted into the hole 36 as shown in FIG. 4(*c*), the lip 18 pulls the over-growing grass 42 into the hole 36 and presses it against the sides of the hole 36. This assists in providing a snug fit for the marker within the hole 36, and quickly and easily solves the problem of the over-growing grass 42 covering the top face 28 of the marker.

Figure 6:
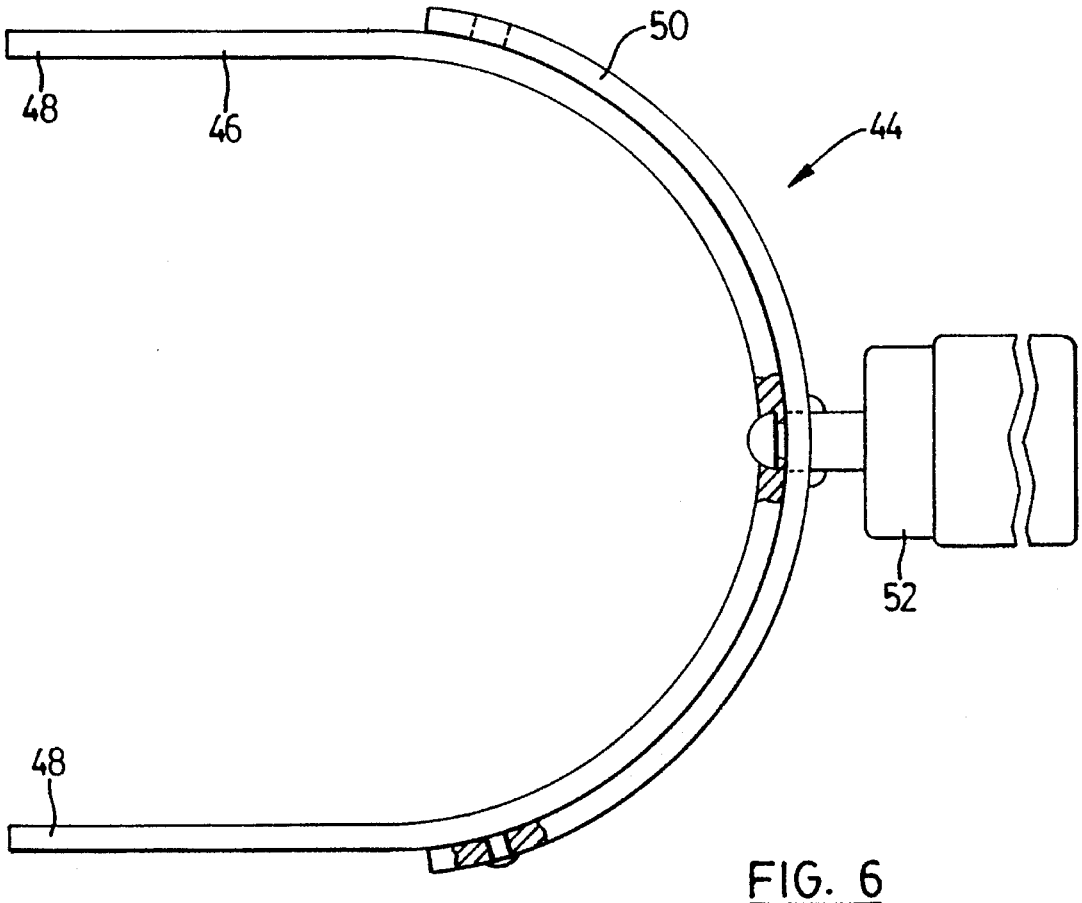
FIG. 6 is a top view of a forked tool for removing the ground marker in accordance with the present invention.
Figure 7:
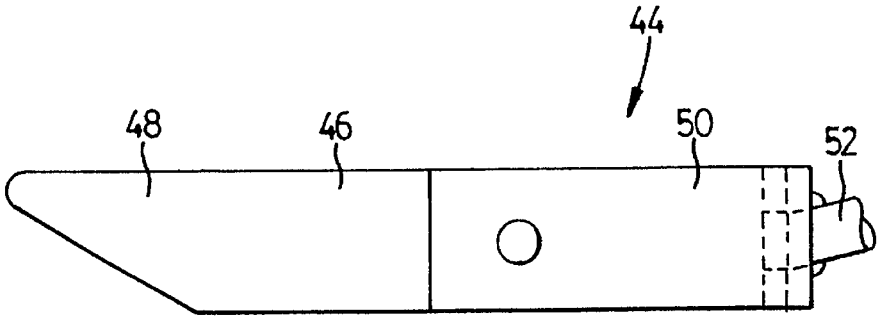
FIG. 7 is a side view of the forked tool of FIG. 6.

Referring to FIGS. 6 and 7, a fork 44 for removing the marker is shown. The fork 44 includes a U-shaped element 46 that defines a pair of spaced tines 48. The distance between the inside surface of the tines 48 is generally equal to the outer diameter of the base 17. The length of the U-shaped element 46 is equal to or less than the outer diameter of the base 17. The ends of the tines 48 are sloped to assist insertion of the tines 48 into the hole 36. The U-shaped element 46 is rigidly attached to a collar 50 by welds, rivets, or other suitable attachment means. The collar 50 is then rigidly attached to a handle 52. The handle 52 is oriented at approximately a 15° angle relative to the tines 48.

In use, the fork 44 is inserted into the hole 36 and pivoted such that the U-shaped element 46 contacts the bottom edge 20 of the lip 18. The bottom edge 20 acts as a means for engaging the forked tool. The handle 52 is then pivoted toward the ground 38 to raise the marker above the hole 36 so that it may be gripped by hand. The angled handle 52 ensures that there is room for the handle 52 to pivot when the U-shaped element 46 is parallel to the lip 18.

It has been found that the markers are difficult to remove from the ground 38 without the assistance of a tool such as the fork 44. This is desirable since it reduces the likelihood of the markers being stolen or vandalized. With the assistance of the fork 44 however, the marker may easily be removed without damaging the hole 36 or the marker so that each may be reused.

Figure 8:
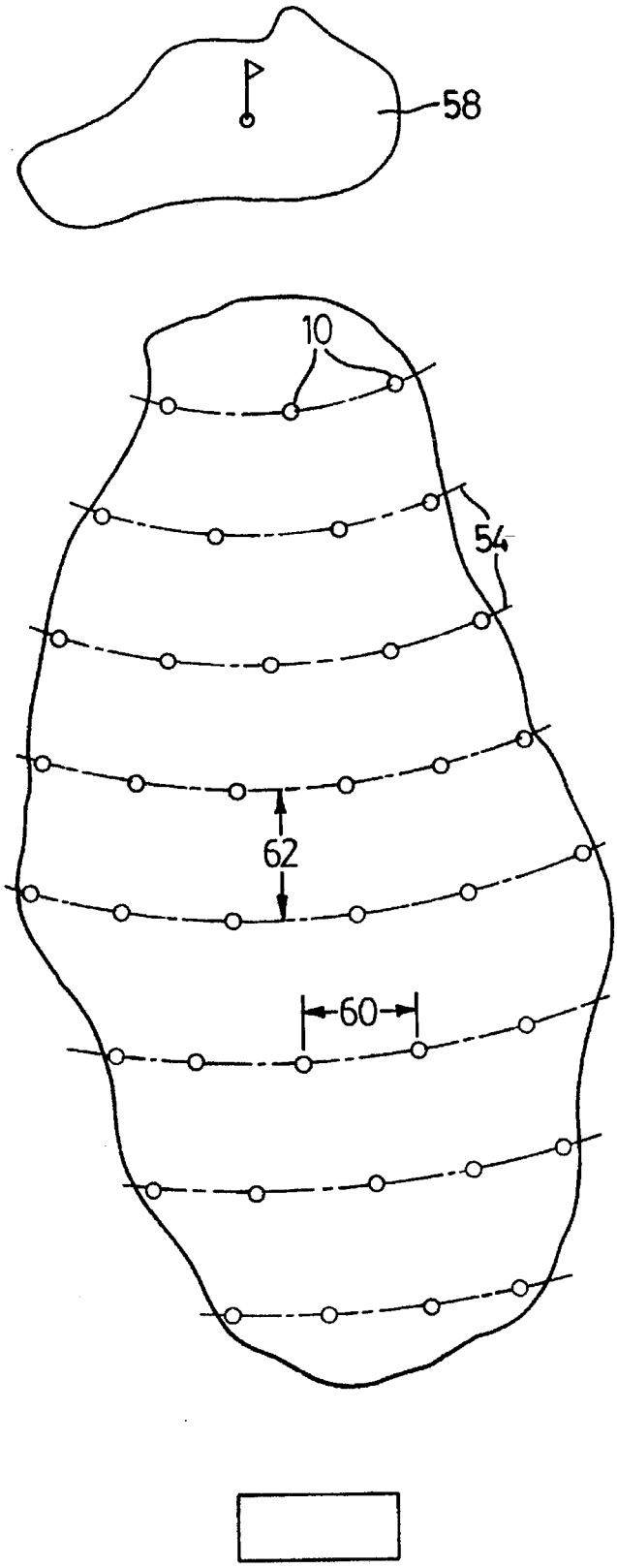
FIG. 8 is a schematic view of a golf hole utilizing the methods for marking distances and advertising in accordance with the present invention.

FIG. 8 shows, schematically, a method for marking distances and/or advertising on a golf course using the markers 10. The system involves the location of the markers on concentric radii 54 measured at predetermined distances from the center of the green 58. It has been found that spacing the markers at intervals 60 of approximately ten yards apart along each radius is appropriate. The number of markers per radius will vary with the size of the intervals 60 and the width of the fairway (the markers could also be located in the rough if they are still capable of being spotted by a golfer). For a typical fairway six markers would be located on each radius. It has been found that a spacing 62 of twenty yards between the radii 54 is appropriate. The first radius may be located at 60 yards from the green 58 and the furthest radius (if required) may be located at 240 yards or more from the green 58. The distance between markers or between radii 54 could be changed however according to the requirements and desires of the individual golf course managers.

It is to be understood that what has been described are preferred embodiments of the invention. The invention nonetheless is susceptible to certain changes and alternative embodiments fully comprehended by the spirit of the invention as described above, and the scope of the claims set out below.

I claim:

1. A ground marker comprising:

a body having a top portion and a base;

said top portion having a generally cylindrical side wall and a horizontal substantially planar transparent top face, said side wall having a greater outer diameter than the outer dimension of said base to define a peripheral lip having a bottom edge; and display means being disposed beneath said transparent top face, said display means being visible through said transparent top face;

wherein said body is adapted to fit in a predetermined size hole defined in the ground with said top face being generally flush with the ground surface and said side wall contacting the side of said hole.

2. A marker as claimed in claim 1, wherein said transparent top face comprises a transparent filler having a hardness comparable to the hardness of a golf fairway.

3. A marker as claimed in claim 2, further comprising a partition extending across said top portion beneath said top face, said partition being adapted to support said display means and said filler.

4. A marker as claimed in claim 1, wherein said base is substantially hollow with a generally cylindrical side wall and an open bottom end.

5. A marker as claimed in claim 1, wherein said base has a bottom end that is bevelled.

6. A marker as claimed in claim 3, wherein said top portion, said base, and said partition are formed as a one-piece unit.

7. A marker as claimed in claim 4, wherein a vent opening is defined in the side wall of said base to permit air flow between the hollow interior of the base and the exterior of the base.

8. A marker as claimed in claim 1, wherein said display means displays both a distance marking and a commercial advertisement.

9. A marker as claimed in claim 8, wherein said display means comprises a card incorporating said markings.

10. A method for marking distances on a golf course, comprising the steps of:

measuring a plurality of concentric radii on the golf course relative to a corresponding golf green;

digging a plurality of predetermined size holes in the ground at spaced intervals along said radii;

inserting a marker into each of said holes, said marker having a top portion and a base, said top portion having a generally cylindrical side wall and a horizontal substantially planar transparent top face, said side wall having a greater outer diameter than the outer dimension of said base to define a peripheral lip having a bottom edge adapted to engage a tool for raising said marker from the ground, and display means being disposed beneath said transparent top face, said display means incorporating distance markings that are visible through said transparent top face, wherein said marker is positioned in said hole with said top face being generally flush with the ground surface; and raising one or more of said markers from said holes with said tool on a periodic basis without substantially damaging said holes to treat said marker or said golf course, and subsequently reinserting said markers in said holes.

11. A method for marking distances as claimed in claim 10, wherein said raising step includes the steps of inserting said tool into said hole so that said tool engages the bottom edge of said lip of said marker, and moving said tool to raise said marker from said hole.

12. A method for marking distances as claimed in claim 10, wherein said step of digging said holes is accomplished with a tool conventionally used for digging holes in a golf green.

13. A method for marking distances as claimed in claim 10, wherein during said inserting step said marker is positioned in said hole with said distance marking aimed in the direction of the center of the green.

14. A method for marking distances as claimed in claim 10, wherein said display means further incorporates a marking bearing a commercial advertisement.

15. A method for marking distances as claimed in claim 10, wherein said base is substantially hollow with an open bottom end, and wherein a vent opening is defined in a side wall of said base to permit air flow between the hollow interior of the base and the exterior of the base.

16. A method of advertising on a golf course, comprising the steps of:

providing a marker having a top portion and a base, said top portion having a generally cylindrical side wall and a horizontal substantially planar transparent top face, said side wall having a greater outer diameter than the outer dimension of said base to define a peripheral lip having a bottom edge, and display means being disposed beneath said transparent top face, said display means incorporating commercial advertising material that is visible through said transparent top face, and submerging said marker into a hole in the ground at a pre-determined location on a golf course so that said top face is generally flush with the ground surface and said side wall contacts the side of the hole; wherein said advertising material remains visible at said top face.

17. A method of advertising as claimed in claim 16, comprising the further step of:

raising said marker from said hole on a periodic basis to permit treatment of said marker or said golf course, and subsequently replacing said marker in said hole.

18. A method of advertising as claimed in claim 16, wherein a distance marking is displayed in combination with said advertising material.

19. A method of advertising as claimed in claim 16, wherein a plurality of said markers are submerged at predetermined distances on said golf course.

20. A method for advertising as claimed in claim 16, wherein said base is substantially hollow with an open bottom end, and wherein a vent opening is defined in a side wall of said base to permit air flow between the hollow interior of the base and the exterior of the base.

* * * * *